US005157830A

United States Patent [19]

Koch

[11] Patent Number: 5,157,830

[45] Date of Patent: * Oct. 27, 1992

[54] METHOD FOR AUTOMATICALLY CONNECTING ELECTRIC CONDUCTORS WITH CONTACT PARTS TO CONNECTOR SHELLS

[75] Inventor: Max Koch, Staatsangehörigkeit, Switzerland

[73] Assignee: TTC Technology Trading Company, Meggen, Switzerland

[ * ] Notice: The portion of the term of this patent subsequent to Jan. 28, 2009 has been disclaimed.

[21] Appl. No.: 572,000

[22] Filed: Aug. 23, 1990

Related U.S. Application Data

[63] Continuation-in-part of Ser. No. 374,271, Jun. 30, 1989, Pat. No. 5,083,370.

[30] Foreign Application Priority Data

Jul. 1, 1988 [CH] Switzerland ..... 2524/88
Apr. 17, 1989 [EP] European Pat. Off. ..... 0 348 615
Feb. 6, 1990 [CH] Switzerland ..... 372/90

[51] Int. Cl.[5] ..... H01R 43/00

[52] U.S. Cl. ..... 29/857; 29/33 M; 29/564.1; 29/748; 414/730; 901/6; 901/30

[58] Field of Search ..... 29/747, 857, 748, 33 M, 29/753, 564.1, 881; 414/736; 901/6, 30

[56] References Cited

U.S. PATENT DOCUMENTS 3,964,147 6/1976 Fusco et al. .
4,074,924 2/1978 Deshich et al. .
4,087,908 5/1978 Fusco et al. .
4,164,065 8/1979 Funcik et al. .
4,375,229 3/1983 Mikami et al. .
4,426,772 1/1984 Collier et al. .
4,557,045 12/1985 Serrano .
4,653,187 3/1987 Sowinski .
4,658,503 9/1987 Eaton .

*Primary Examiner*—Carl J. Arbes
*Attorney, Agent, or Firm*—Horst M. Kasper

[57] ABSTRACT

With this device for an automatic mounting of connector shells (5) and electric conductors, in each case, a connector shell (5) is mounted, with the aid of an industrial robot (1), onto both contact parts (8.1, 8.2) of an electrical conductor at the end of a cable-processing line. Each end of the electric conductors is gripped by the first double gripper (11) of an additional transfer module (40) and, in a mounting position (32), is transferred to a stationary gripper (20). Before this transfer, if the electric conductor is gripped by the first double gripper (11) alone, then the conductor shells are mounted onto the contact parts and the mounting force is tested. After the stationary gripper (20) takes over the electric conductor, the first double gripper carries out a reverse cycle motion into a transfer position (30) in order to grip a new electric conductor. At the same time, after the mounting pressure has been checked, the robot gripper of the industrial robot (1) mounts the connector shell (5) completely onto the contact part (8.1, 8.2) and the perfect mounting is determined by a checking of the withdrawal pressure. The electric conductor (8), equipped with the connector shell (5), is placed by a separating motion of the robot gripper (3) of the industrial robot (1) under the fixed separator element (18).

4 Claims, 9 Drawing Sheets

METHOD FOR AUTOMATICALLY CONNECTING ELECTRIC CONDUCTORS WITH CONTACT PARTS TO CONNECTOR SHELLS

CROSS-REFERENCE TO RELATED APPLICATIONS

This application is a continuation-in-part application of another application filed Jun. 30, 1989 and bearing Ser. No. 07/374,271 now U.S. Pat. No. 5,083,370 issued Jan. 28, 1992. The entire disclosure of this latter application, including the drawings thereof, is hereby incorporated in this application as if fully set forth herein.

BACKGROUND OF THE INVENTION

The present invention relates to a device for automatically connecting electric conductors with contact parts and connector shells between a cable-processing station with a stepwise progressively advancing transfer module and a gripper system with at least one industrial robot. A robot gripper is disposed at the industrial robot and is movable in all directions. A further rotatable transfer module exhibits a double gripper, gripping the two ends of an electric conductor with an outer gripper pair and an inner gripper pair, respectively, and at least one centering device and at least one fixed separator element.

2. Brief Description of the Background of the Invention Including Prior Art

A device for the mounting of electric conductors with contact parts in connector shells has been taught, for example, in the German Patent Application Laid Open DE-OS No. 2,740,377. This device is a so-called rigidly chained system where a crimp device is combined with a plug device. The gripper is moved by two piston cylinder units acting perpendicular relative to each other. The tensioning station is actuated by a further piston cylinder unit for a connector shell. The connector shell itself and further actuating and support means are in an interdependent, rigid relation. The interdependent relation is dependent on the construction and on the predetermined motion path of the device. A flexible mounting of desired contact parts with conductors in arbitrary connector shells is not possible with the taught reference device.

A process and such a device for an automatic mounting of electric conductors with contact parts in connectors shells has furthermore been taught in the European Patent Publication No. EP No. 0,348,615 (based on the Swiss Patent Application CH No. 02,524/88-6) over which the instant invention represents an improvement. The Swiss Patent Application teaches a process and a device where the connectors shells are mounted by a robot gripper to the ends of a completely processed cable, and where the ends of the completely processed cable are gripped by a double gripper at the end of a cable processing station. Both ends of the cable are gripped with a double gripper, where the front part of the double gripper grips at the connector contact and the rear part of the gripper grips at the insulation of the cable. Both grippers of the double gripper can be controlled independent of each other. For the mounting of the connector shells, both grippers of the double gripper are closed and support the end of the cable in the mounting and/or insertion direction of the connector shell. The connector shells are held by one gripper of a robot arm and are in each case cyclically mounted at the end of a cable. The mounting force is captured by a sensor disposed at a robot gripper in order to detect defective parts at the connector contact or at the connector shell and to exclude an erroneous mounting. If no errors or deficiencies are found, the front part of the double gripper is opened and is spread outwardly and the connector shells is completely mounted onto the end of the cable with the aid of the robot arm. The perfect mounting of the mounted cable connection is checked by a separating motion of the robot arm. The separating motion of the robot arm is monitored by a further sensor disposed at the robot gripper. The pivoting motion of the robot gripper serves to bring the mounted cable under a deflector in order to free the connector for the mounting onto the end of a cable newly gripped by the double gripper.

One disadvantage of this mounting device is that the robot gripper becomes heavy due to the mounting of both sensors and this impedes the required high precision of its motions. It is a further disadvantage that the time requirement for the necessary robot motions for connecting and mounting of the connector shells to one end of a cable, for the monitoring of the mounting force and the separating force, and for the deflection of the cable connected with the connector shell, is larger than the cycle time of the cable-processing line. This disadvantage reduces the capacity of the cable-processing line.

In the process of assembling and automatically connecting electrical conductors with contact parts to connector shells, it is required to center such items relative to each other such that a proper insertion can be performed. The European Patent Application, Publication No. 0,041,332 to Kunitada Tominoi, teaches an apparatus for a method of inserting terminals into an electrical connector housing.

The SMC Corporation commercially distributes in Switzerland two-finger parallel grippers and two-finger angle grippers which are actuated pneumatically. The company issues a flyer relating, for example, to the models MHC20D, MHP25D, and others, which can be used to provide gripping. Mounting more than one of such grippers of the SMC Corporation to a single frame results in multiple grippers, such as double grippers.

The inductive proximity switches, which have been disclosed, are commercially sold by GERHARD BALLUFF & CO., Postfach 1159, D-7303 Neuhausen, Federal Republic of Germany. Such inductive proximity switches are useful in determining the approach of moving elements.

SUMMARY OF THE INVENTION

1. Purposes of the Invention

It is an object of the invention to provide a device for the mounting of connector shells onto electric conductors where the cycle time required for the connection, the mounting, and the checking of a connector shell onto an end of an electrical conductor, is not larger than the cycle time of the cable-processing line.

It is a further object of the invention to provide a device where the precision of the motions of the robot gripper are not impaired.

It is yet a further object of the invention to provide a system where identical or differing connector shells with electric conductors can be equipped or furnished with identical or differing contact parts fully automatically with an industrial robot.

These and other objects and advantages of the present invention will become evident from the description which follows.

2. Brief Description of the Invention

The present invention provides for a device for an automatic mounting of electric conductors with contact parts and connector shells. A cable-processing line comprises a stepwise advancing transfer module. A gripper system includes at least one industrial robot having a universally movable robot gripper. A rotatable transfer module includes a double gripper having a first side and having a second side and incorporating an inner gripper pair and an outer gripper pair. The double gripper grips the two ends of an electric conductor in each case with the outer gripper pair and with the inner gripper pair. A first mounting test-device is disposed on the first side of the double gripper. A second mounting test-device is disposed on the second side of the double gripper. The invention device also includes one centering device and one fixedly disposed separator element. A stationary gripper for grips the ends of the electric conductor between the outer and the inner gripper pairs of the double gripper. A control device is disposed on the stationary gripper for the testing and checking of the connector connection.

A common guiding track can support the outer and the inner gripper pairs of the double gripper for sliding on the common guiding track in a direction parallel to an axis of a gripped electric conductor. An outer pretensioned spring can be disposed on the outer gripper pair for maintaining an operation condition of the outer gripper pair. An inner pretensioned spring can be disposed on the inner gripper pair for maintaining an operation condition of the inner gripper pair. An outer sensor can be disposed at the outer gripper pair. The outer sensor can respond upon a displacement out of the working position of the outer gripper pair. An inner sensor can be disposed at the inner gripper pair. The inner sensor can respond upon a displacement out of the working position of the inner gripper pair. The inner sensor and the outer sensor can be furnished by a contactless probe responding by a covering the respective front side with a sheet-metal tongue.

A control arrangement can trigger a reverse motion and a renewed mounting motion of the robot gripper holding the connector shell. The control can be provided with final control elements initiating relative motions.

The control device of the stationary gripper can be furnished with a pneumatic piston-cylinder unit for the surveillance of the mounting pressure and of the withdrawal pressure.

A plurality of insertion openings in the double gripper can receive different contact parts. The members of the plurality of insertion openings can exhibit different size dimensions. The outer gripper pair can be slidably supported perpendicular to the axial direction of the gripped electric conductor.

A sliding track can be disposed parallel to a position of an axis of a gripped electric conductor during the mounting procedure for slidably supporting the stationary gripper. The stationary gripper can be held in a working position by the pneumatic control device.

A support bracket can be disposed at the yoke. A contactless sensor can be disposed at the support bracket and survey a displacement of the stationary gripper.

A removal device can be disposed at the stationary gripper for removing a defective electric conductor.

The outer gripper pairs of the double gripper can be furnished with a plurality of insertion openings for supporting an electric conductor.

A method for an automatic mounting of electric conductors, having contact parts, to connector shells comprises the following process steps. At least one connector shell is gripped from a connector-shell magazine with a gripper tool supported by a gripper. Two contact parts of an electric conductor are centered at an end of a cable-processing line. The two contact parts are maintained in a rest position at the insulated conductor by respectively two gripper pairs of a double gripper. At least one gripper is moved in the direction of a contact part of the electric conductor. A connector shell having a recess is shifted, with the recess to align at a contact part of the electric conductor. A front gripper pair of the double gripper opens by itself. The front gripper pair grips at the contact part of the electric conductor. The connector shell with the gripper is fully shifted onto the contact part of the electric conductor for inserting the contact part into a recess of the connector shell. A rear gripper pair of the double gripper opens. A separating motion below a fixed separator element is carried by the gripper with the inserted electric conductor for obtaining a finished equipped cable harness.

An insertion process of a connector shell at the contact part of the electric conductor can be repeated upon a surpassing of a preset insertion force after a return motion of the gripper. An electric conductor can be eliminated after a futile repeating of the insertion process. The gripper can be moved in a reverse direction relative to the insertion direction for testing the process result of the assembly of the connector shell onto the contact part of the electric conductor. The double gripper can be rotated by half a rotation around its longitudinal axis for plugging together the second contact part of the electric conductor with a respective connector shell. A finished equipped cable harness can be bound and the cable harness can be electrically tested.

The advantages of the present invention include an in-line arrangement of two fixed grippers for receiving the two ends of a completely processed cable. The two fixed grippers control simultaneously the correct connection and the perfect mounting of the connector shell by means of a pneumatic surveillance of the mounting pressure and the separating pressure, respectively. The in-line arrangement of the two fixed grippers, on the one hand, decreases the cycle time for the robot gripper and adapts this cycle time to the cycle time of the cable-processing line and, on the other hand, the displacement of the monitoring devices for the perfect connection and mounting of a connector housing onto the end of a cable from the robot gripper to the double gripper or, respectively, to the fixed gripper, does not bring about a large weight increase for the robot gripper and does thus not impair the motion sequences of the robot gripper.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
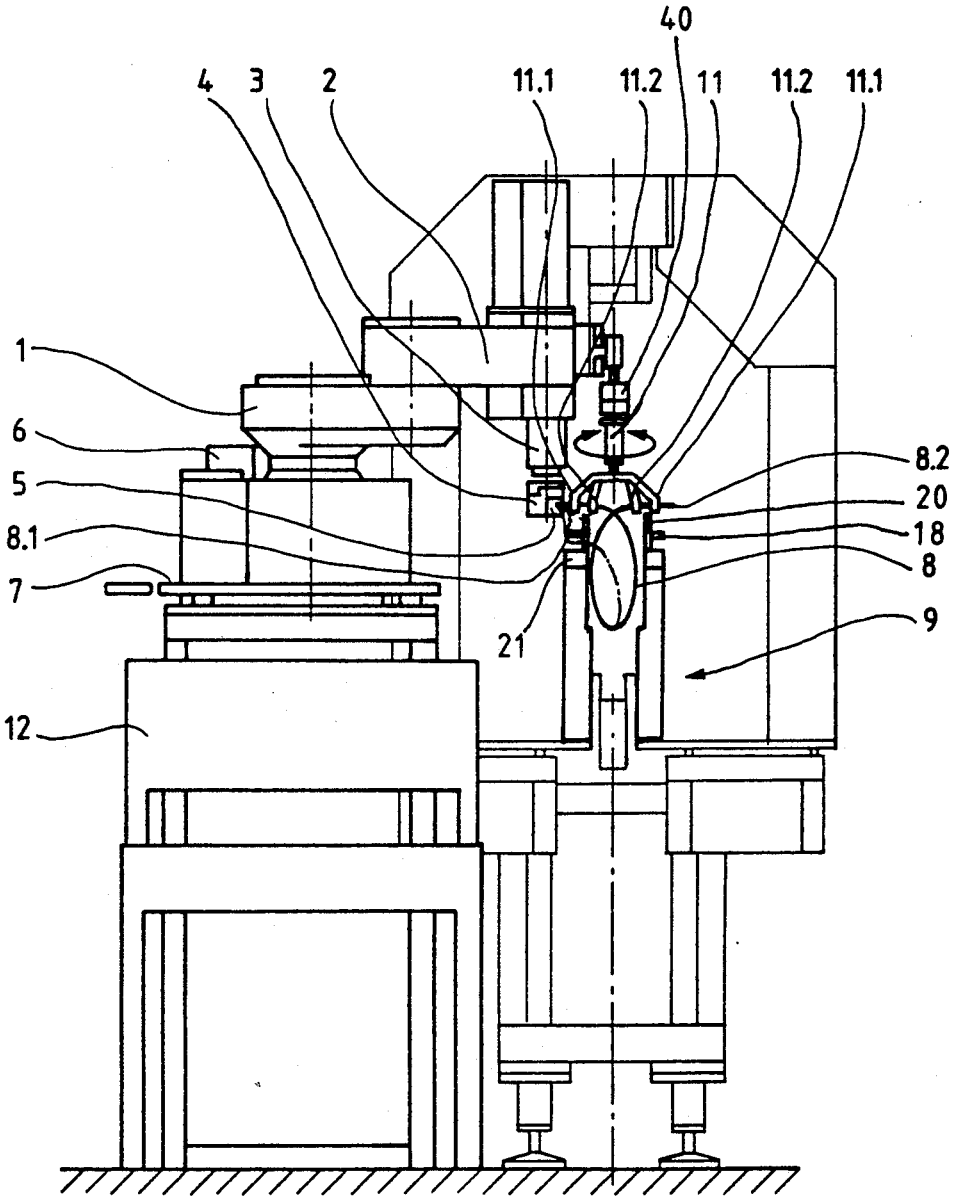
FIG. 1 is a schematic side-elevational view of a device for automatically connecting connector shells and electric conductors with contact parts, disposed at an end of a cable-processing station, using an industrial robot and a rotatable gripper module.

In accordance with the present invention, there is provided a device for automatic mounting of electric conductors 8 with contact parts 8.1, 8.2 and connector shells 5, between a cable-processing line with a stepwise advanceable transfer module 10 and a gripper system with at least one industrial robot 1 having a universally movable robot gripper 3. An additional, rotatable transfer module 40 exhibits a double gripper 11, gripping the two ends of an electric conductor 8 in each case with an outer and an inner gripper pair 11.1, 11.2. At least one centering device 19 and at least one fixed separator element 18 are provided. The double gripper 11 exhibits on both sides a mounting test-device. In each case a stationary gripper 20 is provided. Said stationary gripper 20 grips the ends of the electric conductor 8 between the outer and the inner gripper pairs 11.1, 11.2 of the double gripper 11. The stationary gripper 20 is provided with a control device 21 for the testing and checking of the connector connection.

The outer and the inner gripper pairs 11.1, 11.2 of the double gripper 11 can be supported and slidable on a common guiding track 11.5 in a direction parallel to the axis of the gripped electric conductor 8. The outer and the inner gripper pairs 11.1, 11.2 can exhibit in each case a pretensioned spring 24 for maintaining an operating position. The outer and the inner gripper pairs 11.1, 11.2 further exhibit, in each case, a sensor 25. The sensor 25 can respond upon a displacement out of the working position of the outer and the inner gripper pair 11.1, 11.2. The sensor 25 can be furnished by a contactless probe responding by covering the front side with a sheet-metal tongue 11.8. A control can trigger a reverse motion and a renewed mounting motion of the robot gripper 3 with the connector shell 5. The control can be provided without initiating relative motions. The outer gripper pairs 11.1 of the double gripper 11 can be furnished with more than one insertion opening 22, 23 for receiving of an electric conductor 8.

The control device 21 of the stationary gripper 20 can be furnished with a pneumatic piston-cylinder unit for surveillance of a mounting pressure Pl and of a withdrawal pressure P2. The insertion openings 22, 23 for receiving of different contact parts 8.1, 8.2 can exhibit different dimensions. The outer gripper pair 11.1 can be slidably supported perpendicular to the axial direction of the gripped electric conductor 8. The stationary gripper 20 can be slidably supported in a sliding track 20.1 parallel to the axis of a gripped electric conductor 8. The stationary gripper 20 can be held in a working position by the pneumatic control device 21. A non-contact sensor 46 can be disposed at the support bracket 42 and can survey a displacement of the stationary gripper 20. A removal device 26 can be disposed at the stationary gripper 20 for removing a defective electric conductor 8.

A method for the automatic mounting of electric conductors 8 with contact parts 8.1, 8.2 in connector shells 5 with a gripper system includes the following process steps: A gripper tool 4, supported by a gripper 3, grips at least one connector shell 5 from a connector-shell magazine 7.1, 7.2, 7.3. The two contact parts 8.1, 8.2 of The electric conductors 8 are centered at the end of a cable-processing line and are maintained in a rest position at a contact part 8.1, 8.2 and at the electric conductor 8 by respectively two gripper pairs 11.1, 11.2 of a double gripper 11. At least one gripper 3 moves in the direction of a contact part 8.1, 8.2 of the electric conductor 8 and shifts a connector shell 5 with one of its recesses to align at a contact part 8.1, 8.2 of the electric conductor A front gripper pair 11.1 of the double gripper 11, gripping at the contact part 8.1, 8.2 of the electric conductor 8, opens itself. The gripper 3 shifts the connector shell 5 fully onto the contact part 8.1, 8.2 of the electric conductor 8. A rear gripper pair 11.2 of the double gripper 11 opens. The gripper 3 carries out with the inserted electric conductor or conductors a separating motion below a fixed separator element 18.

The separator element 18 has the purpose to maintain electrical conductors already connected to one plug casing to hold in a proper position, that is, for example, to hold them down, so that the plug casing can be plucked without difficulties with remaining recesses to new additional electrical conductors. The separator element itself is a device which is fixedly placed. The electrical conductors already connected to the plug casing are placed below the separator element 18 and in fact by a corresponding tilting motion of the robot-gripper together with the grip plug casing. The separator element 18, for example, is a usual flat piece of iron with a round strip area as illustrated at the top of an accompanying drawing labeled FIG. 6. The separator element is illustrated in FIG. 1 from the front and in FIG. 3 from the side. In addition, an electrical conductor is shown with a dash-dotted line in FIG. 1 while it is disposed on one side of the separator element 18, after the pivoting motion of the robot-gripper, while the electrical conductor is deflected downward, relative to the plug casing 5. FIGS. 11 through 15 also indicate the relative position of the separator element.

The slide-on process of a connector shell 5 at the contact part 8.1, 8 2 of the electric conductor 8 can be repeated upon a surpassing of a preset put-on force after a return motion of the gripper 3. The electric conductor 8 can be eliminated after a futile repeating of the slide-on process. Preferably the gripper 3 tries to perform a motion opposite to the shift-in direction for testing the assembly process of the connector shell 5 on the contact part 8.1, 8.2 of the electric conductor 8. The double gripper 11 can be rotated by half a rotation around its longitudinal axis for plugging together the second contact part 8.2 of the electric conductor 8 with connector shells 5. The finished equipped cable harness 13 can be bound off. The cable harness 13 can be electrically tested.

Figure 2:
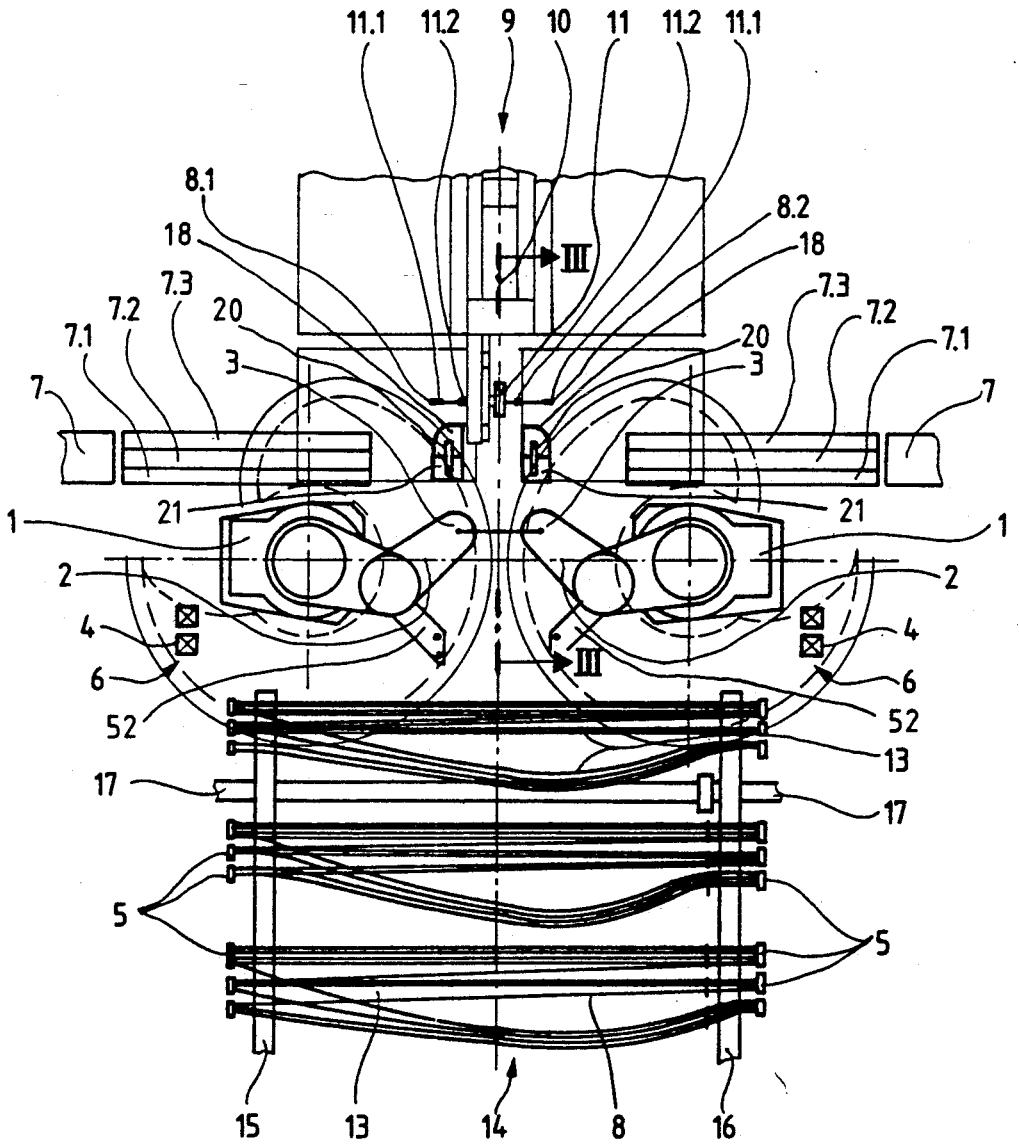
FIG. 2 is a top planar, schematic view of the embodiment according to FIG. 1 with two industrial robots, an additional transfer module with rotatable double gripper, two fixed gripper modules, two industrial robots, and a transport device for the discharge transport of finished cable harnesses in a partially extended state.
Figure 3:
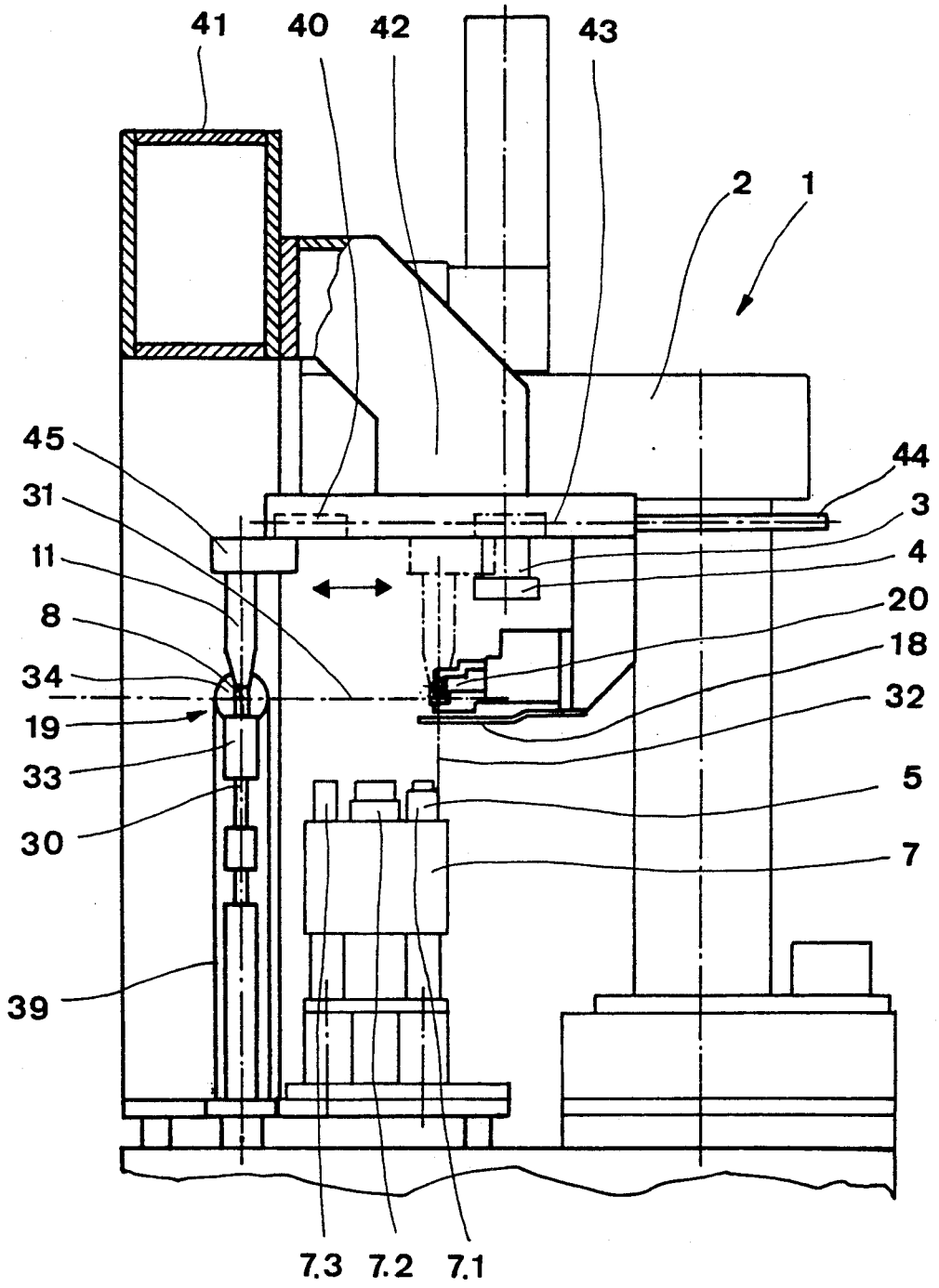
FIG. 3 is a side elevational and in part sectional view through the additional transfer module along section line III—III of FIG. 2.
Figure 7:
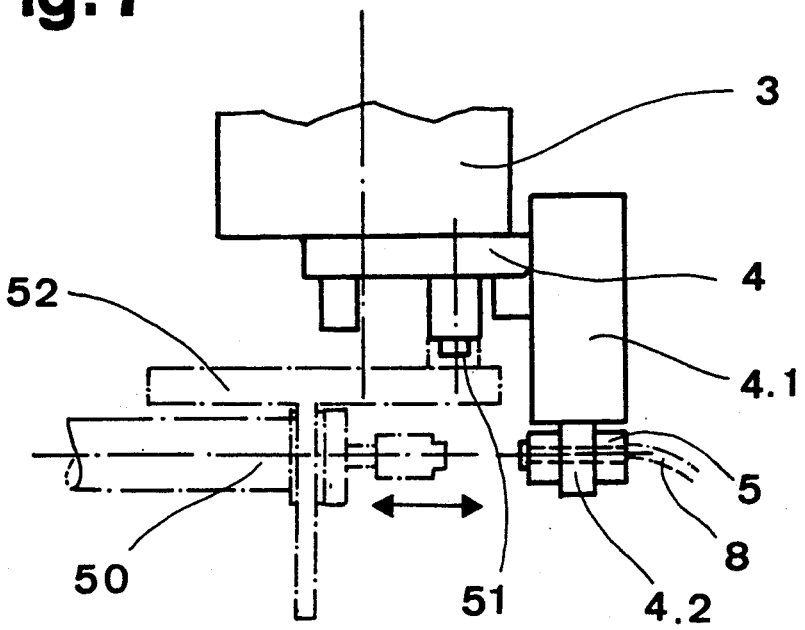
FIG. 7 is a sectional view of the lowermost part of the robot gripper with an attached gripper tool.
Figure 8:
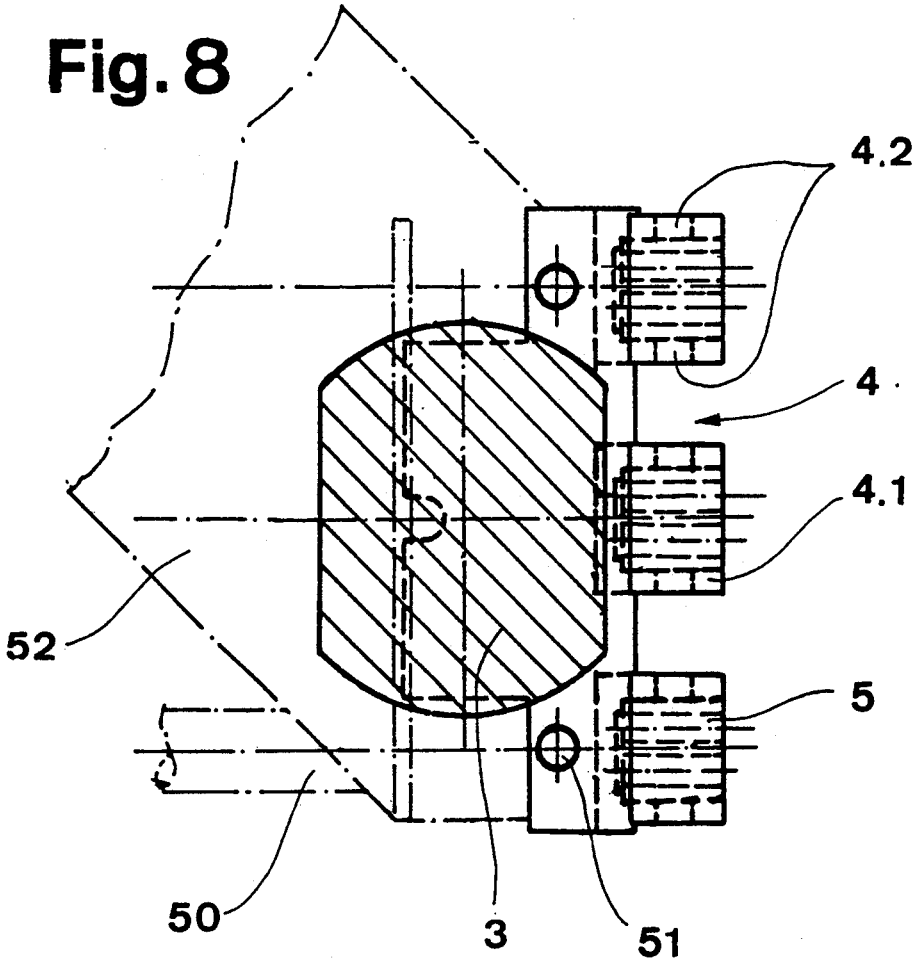
FIG. 8 is a sectional view of the gripper tool according to FIG. 7, for the reception of three identical connector shells.

An industrial robot is designated with the reference numeral 1 in FIGS. 1, 2, and 3. The industrial robot 1 exhibits a gripper arm 2 and a robot gripper 3. Different gripper tools 4 for a connector shell 5 or for several identical or different connector shells 5 can be gripped with the robot gripper 3. The robot gripper 3, with the gripper tool 4, for the gripping of the connector shells, is disposed at the robot gripper arm 2. The gripper tools are assembled from conventional pneumatic gripper elements for the gripping of the individual connector shells. The gripper tools 4 are disposed and supported in the tool magazine 6 in the area of the industrial robot. Under normal circumstances, these gripper tools are only exchanged upon program changes, i.e. relatively seldom. This manipulation and the exchange could, in principle, be carried out manually. The arrangement of the gripper tool at the robot gripper is more clearly illustrated in FIGS. 7 and 8. The robot gripper 3 of the industrial robot 1 can pick up the gripper tool 4 for accepting the desired connector shells 5 corresponding to each intended cable-harness process from the tool magazine 6. In this case, a snap and/or a closing connection furnish a connection between robot gripper 3 and gripper tool 4. This connection is not part of the invention and is therefore not described in more detail. It is also possible to manually place the gripper tool 4 at the robot gripper 3, since the gripper tool has to be exchanged only in case of complete programming changes, which occur very seldom. The illustrated gripper tool 4 exhibits three identical gripper modules 4.1 with grippers 4.2, which are disposed at uniform distances from one another and which each hold an identical connector shell 5. The connector shells 5 are stored in a connector-shell magazine 7 within reach of the industrial robot 1 with, for example, three parallel and side-by-side disposed connector-shell magazines 7.1, 7.2, 7.3. The connector-shell magazines 7.1, 7.2, 7.3 exhibit the same distance as the gripper module 4.1 of the gripper tool 4. Upon each removal of connector shells 5 with the aid of the gripper tool 4, of the robot gripper 3, the connector-shell magazines 7.1, 7.2, 7.3 are automatically resupplied with new connector shells 5. The supply of the connector shells 5 is not a part of the instant invention and is therefore not described in more detail. Thus, several identical connector shells 5, or in case of a corresponding device, several different connector shells 5 can be placed simultaneously in one process cycle with the aid of the gripper tool 4 and the robot gripper 3. A bracket 52 is indicated by dash-dotted lines in FIGS. 7 and 8. This bracket 52 is provided when the electric conductors 8, equipped with the connector shells, of a finished cable harness are to be additionally secured. In this case, the robot gripper 3 is mounted with a locking peg of the robot gripper tool 4 engaging in an opening 51 on the bracket 52, and a pneumatically actuated handle locks and secures the electric conductors 8 in the connector shells 5.

The contact parts 8.1, 8.2 of an electric conductor 8 are prepared in a processing line 9, not belonging to the subject-matter of the invention. The contact parts 8.1, 8.2 of the electric conductor 8 are moved forward in clock cycles by a first transfer module 10. The two contact parts 8.1, 8.2 of the electric conductor 8 and the electric conductor 8 itself are received, while in a transfer position, by a fixed intermediate module 33, respectively, at the end of a processing line 9. The area between the processing line for the production of the electric conductors 8 and the attachment of these electric conductors to connector shells by the industrial robot, where the device for the automatic mounting of these parts is set up, is illustrated in FIG. 3. An additional transfer module 40 is disposed above a conductor plane 31 with the aid of a yoke 41 and a support bracket 42 affixed at the yoke 41. The additional transfer module 40 is movably disposed on sliding guides 43 between the transfer position 30 and a mounting position 32. A pneumatic regulating member 44 is responsible for the back and forth motion.

A double gripper 11 with a rotation module 45 is attached at the transfer module 40. In the transfer position 30 of the stationary intermediate module 33, the double gripper 11 takes over both ends of the electric conductor 8. Furthermore, two stationary grippers 20 are disposed at the support bracket 42 of the yoke 41. The two stationary grippers 20 take over the ends of the electric conductors 6 in the mounting position 32 from the double gripper 11 of the additional transfer module 40. The double gripper 11 is comprised of individual conventional pneumatic gripper elements. These gripper elements are disposed at the transfer module 10 for the correct gripping of the electrical conductors. Each gripper element is movable and controllable independent of one another. This allows that the connector shells can be completely slid onto the contact part of the electrical conductor. In this case, the electrical conductor is also gripped by the inner gripper pairs 11.2, while the outer gripper pairs 11.1 are opened up and free for an insertion of the connector shell. This insertion phase is schematically illustrated in FIGS. 9 through 15 of the application. This double gripper is not disposed at the robot but at the transfer module 10, which transfer module is disposed at the end of the cable-processing line.

Figure 9:
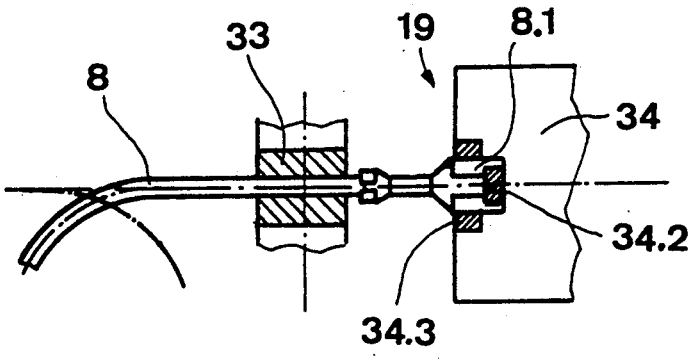
FIG. 9 shows a sectional, elevational view of a first phase of the mounting of the connector shells to the contact parts of electric conductors, illustrating an end of an electric conductor held by an intermediate module during the centering of the contact part by the centering module.
Figure 10:
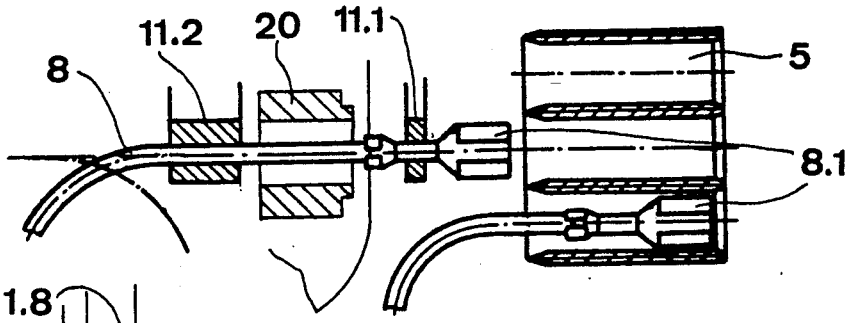
FIG. 10 shows a sectional, elevational view of a second phase of the mounting of the connector shells to the contact parts of electric conductors, illustrating a connector shell, gripped and taken up by the gripper tool of the robot gripper, positioned at the centered end of the electrical conductor gripped by the double gripper, and transported into the mounting position.

For the deflection of the electrical conductor 8, equipped with a connector shell 5, for each stationary gripper 20, in each case, a fixed separator element 18 is also fixedly attached at the same support bracket 42. A centering device 19 with a centering module 34 is provided for each end of the electric conductor 8 in the transfer position 30. The purpose of the centering device 19, illustrated in FIGS. 3 and 9, is to bring the contact parts of the electric conductor into a desired position for the insertion of a connector shell before the electric conductors are definitely gripped by the double gripper.

Figure 5:
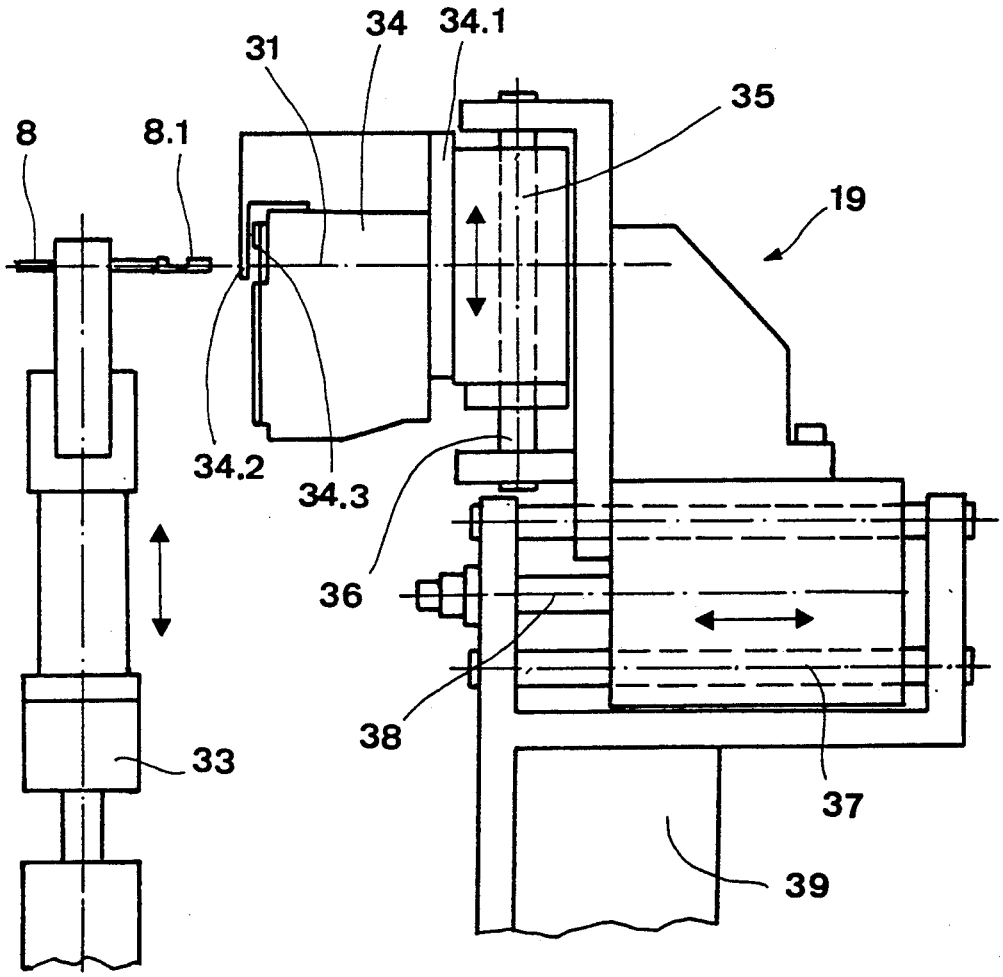
FIG. 5 is a side elevational view of the centering module and the intermediate module for a precise centering of contact parts of the ends of the electric conductor.

The contact part 8.1, 8.2 of the electric conductor 8 can be brought into a desired position with the aid of the centering device 19 and the centering module 34. The disposition of the centering device 19 is illustrated in more detail in FIG. 5. The centering device 19 includes a bracket 39, the centering module 34, a rotation module 34.1, a sliding guide 35 disposed perpendicular to the axis of the gripped electric conductor 8, a pneumatic sliding device 36, a sliding guide 37 disposed parallel to the axis of the gripped electric conductor 8, and a pneumatic sliding device 38. Thus, the centering module 34 is slidably supported in two planes and can be pneumatically advanced and moved to the end of the electric conductor held by the intermediate module 33. The centering module 34 exhibits two gripper pairs 34.2, 34.3 which can be swivelled by 180 degrees. The contact part 8.1 of the electric conductor 8 can be brought into the desired position with the aid of the gripper pairs 34.2, 34.3. The rotation module 34.1 can rotate the contact part 8.1, for example, by 90 degrees, 180 degrees, or 270 degrees relative to its longitudinal axis before the electric conductor 8 is taken over by the double gripper 11 of the additional transfer module 40. The double gripper 11 is moved back and forth between the transfer position 30 and the mounting position 32 with the aid of the additional transfer module 40. The contact parts 8.1, 8.2 of a gripped electric conductor 8 are thereby positioned in the conductor plane.

Figure 4:
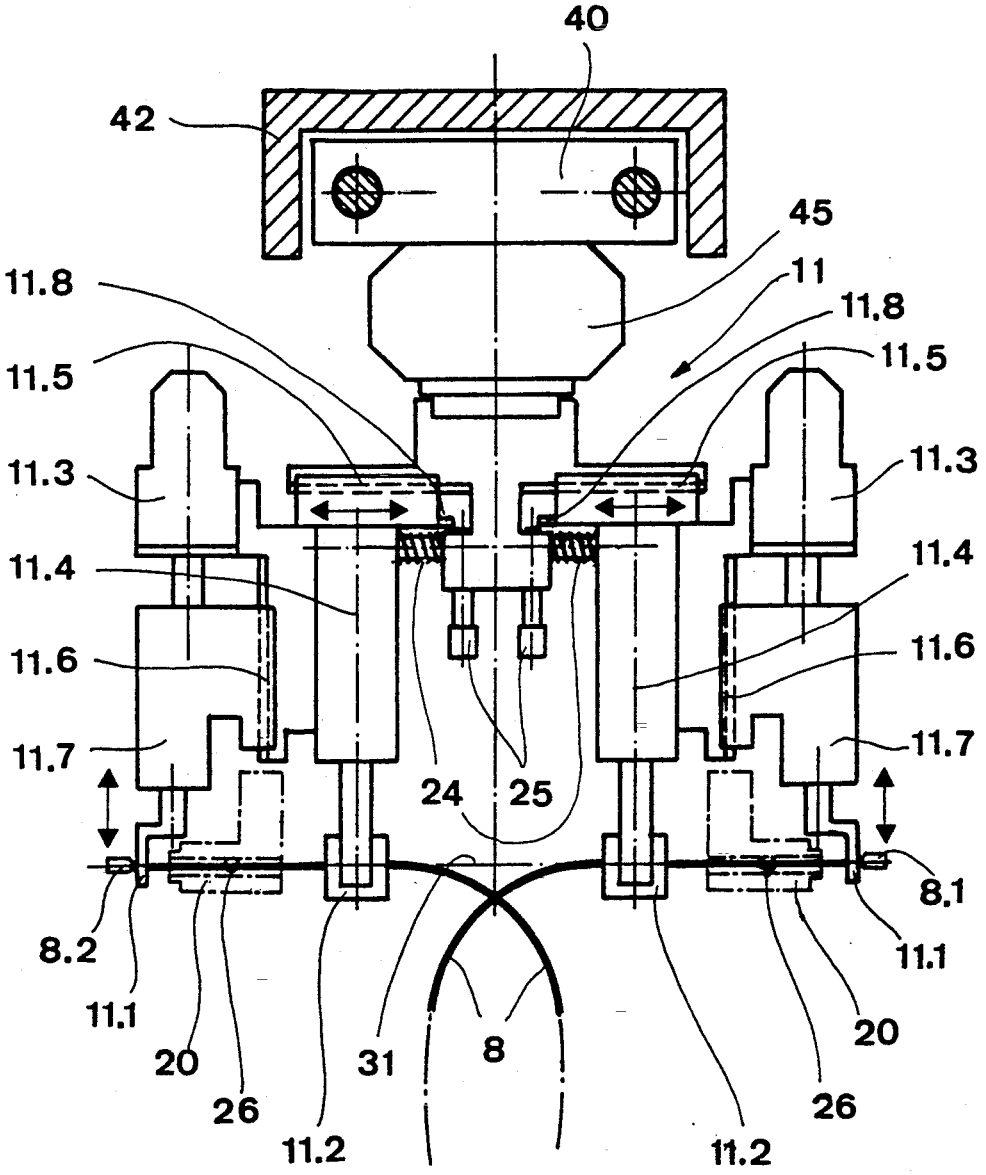
FIG. 4 is a side sectional view of the double gripper with the rotation module and the transfer module, where both gripper pairs grip one end of an electric conductor, respectively.

The double gripper 11 is illustrated in more detail in FIG. 4. The double gripper includes in each case two outer gripper pairs 11.1, two inner gripper pairs 11.2. The double gripper 11 is connected to the rotation module 45 and the additional transfer module 40. The displacement of the additional transfer module 40 occurs with the pneumatic regulating member 44. Perpendicular to the axis of the gripped electric conductor 8, the outer gripper pairs 11.1 are slidably supported on a sliding guide 11.6 at the inner gripper pair 11.2. The outer gripper pairs 11.1 can be moved up and down with a pneumatic device 11.3 in order to move the gripper pairs 11.1 into or out of a work area or, respectively, the gripper pairs 11.1 can be opened or closed with a further pneumatic device 11.7. The inner gripper pairs 11.2 are attached to a pneumatic device 11.4 for the swinging apart (opening) or closing of the grippers. The inner and outer gripper pairs 11.1, 11.2 are slidably disposed on a common guide track 11.5 parallel to the axis of the gripped ends of the electric conductor 8. The inner and outer gripper pairs 11.1, 11.2 are maintained in an operative position by the force of a pretensioned spring 24. Sensors 25 survey a possible displacement of the two gripper pairs in axial direction of the gripped electric conductor. The sensor for testing of the insertion force and of the withdrawal force is disposed at the robot gripper 3. A contactless, conventional sensor can be used which surveys a displacement of the connector shell relative to the gripper tool, where said displacement can occur upon exceeding of a preset force. Thus, the non-contact sensors are disposed in the instant exemplified embodiment in such a way that the front side of the sensor is covered with a sheet-metal tongue 11.8 upon a displacement of the gripper pairs 11.1, 11.2, whereby the sensor is actuated. The outer gripper pair 11.1 grips a prepared end of the electric conductor 8 in the rear region of the contact part 8.1, 8.2, after the contact part 8.1, 8.2 is aligned as desired by the centering device 19, whereas the inner gripper pair 11.2 grips in the region of the insulation of the electric conductor 8. The two gripper pairs 11.1, 11.2 of the double gripper 11 are spaced apart from each other in such a way that in each case the stationary gripper 20 grips each end of the electric conductor 8 between the two gripper pairs 11.1, 11.2 of the double gripper 11 immediately behind the contact part 8.1, 8.2 for accepting and taking over of the electric conductor while in the mounting position 32.

Figure 6:
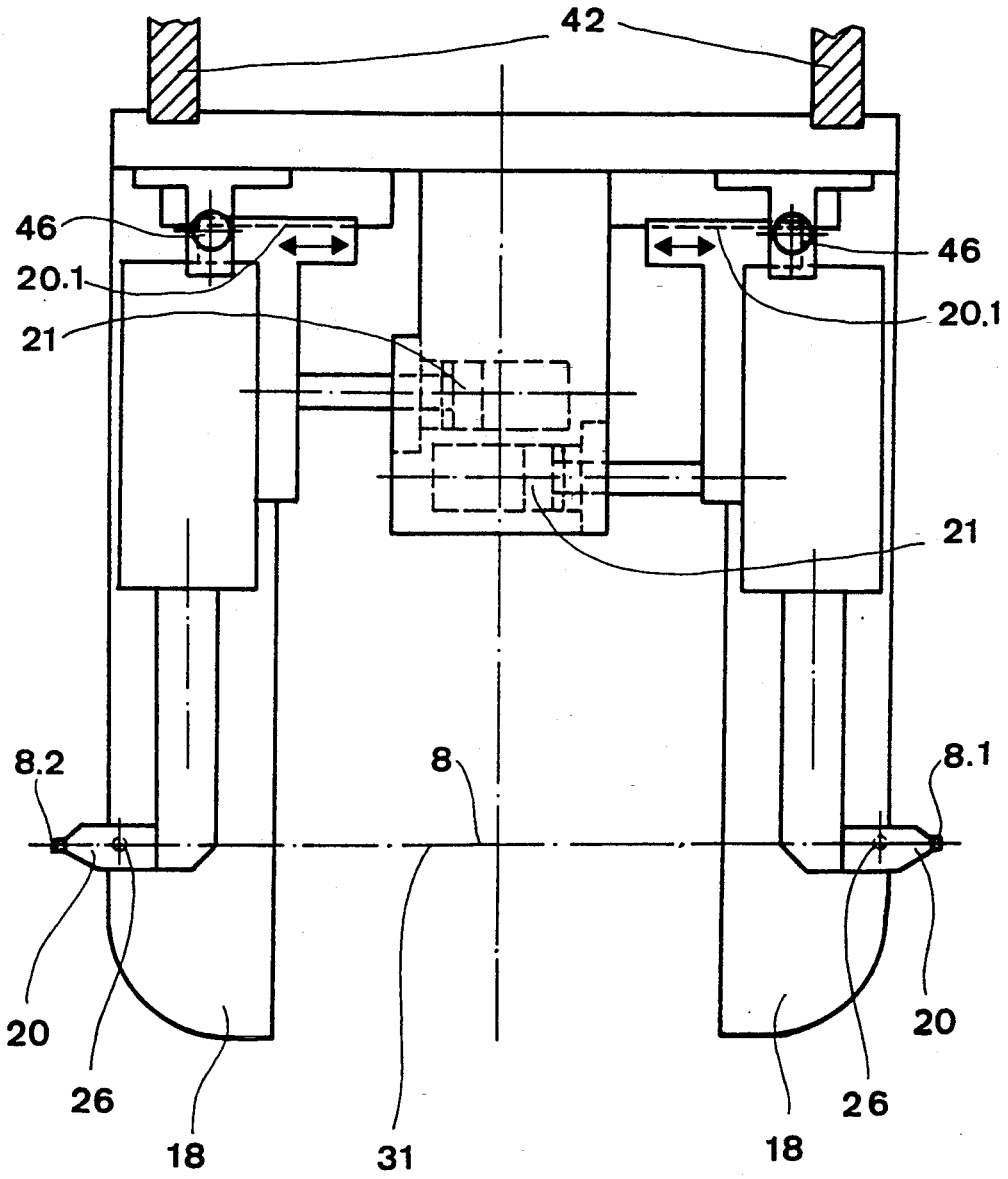
FIG. 6 is a top plan view of a stationary gripper for a reception and accommodation of the ends of the electric conductors for a mounting with connector shells, together with the fixed and stationary separator elements.

The stationary gripper is illustrated in more detail in FIG. 6. A stationary gripper 20 is disposed at the support bracket 42 of the yoke 41 for each contact part 8.1, 8.2 of the electric conductor 8. Each stationary gripper 20 is slidingly guided on a sliding track 20.1 parallel to the axis of the gripped electric conductor 8 and is maintained in an operative position by a pneumatic control device 21. The mounting force or, respectively, after the final mounting, the withdrawal force, is surveyed with the pneumatic control device 21 upon mounting of the connector shells 5 with the robot gripper 3 onto a contact part 8.1, 8.2 of the electric conductor. A non-contact sensor 46 responds to a possible displacement of the stationary gripper 20 when the mounting force exceeds the preset and fixed value. The electric conductor is discharged.

A blow-off device 26 is disposed in the region of the gripping device of the stationary gripper 20. An eliminated electric conductor 8 is removed from the work area with the aid of the blow-off device 26. If a connector shell 5, upon testing of the withdrawal force, can be withdrawn with a lower withdrawal force from the contact part 8.1, 8.2 of the electric conductor 8 than the fixedly set withdrawal force, then the electric conductor 8 is likewise eliminated and blown off. A fixed separator element 18 is disposed at the support bracket 42 in the region of each of the stationary grippers 20 for the deflection of an electric conductor 8 equipped with a connector shell 5. The fixed separator element has merely the task of deflecting the inserted electric conductor. This separator element is fixedly disposed and does not carry out any motion. The motion that is necessary for placing the electric conductor under this separator element is carried out by the robot gripper with the gripped connector shell.

The end of the cable-processing line 9 for the production of the contact parts of the electric conductor is shown in the upper part of the schematic representation in FIG. 2. The transfer module 10 with the double gripper 11 is disposed between said end of the cable-processing line 9 and the industrial robots 1. The electrical cables, which are cyclically transferred by the cable-processing line to the double gripper, are cyclically moved with the transfer module into the area of the industrial robots, where the robot grippers insert the connector shells, removed and gripped by the gripper tools from the connector shell magazines, onto the cyclically fed electrical cable until an entire cable harness is formed. The cable harness is transferred in an extended state by the industrial robots with the aid of the gripped connector shells to the transport device 14, illustrated below the industrial robot.

A discharge bin can be disposed after the device for automatically connecting connector shells 5 and electric conductors 8 with contact parts 8.1, 8.2, and the completely assembled cable harnesses 13 can be placed in the discharge bin, as illustrated in FIG. 1. Alternatively, there can be provided a transport device 14, as illustrated in FIG. 2. These additional variants are not a direct object of the instant invention and are therefore not described in more detail. The transport device 14 can be a twin-belt drive, which is comprised, in each case, of two endless rubber-band pairs 15, 16, which can be moved apart and which, in each case are disposed in parallel, one above the other. The rubber bands, disposed one above the other, are driven with a different direction of rotation. The cable harnesses 13 are, preferably in a stretched state, clamped and carried along between the two center rubber-band strands of the twin-belt drive running in the same direction. At least one binding device 17 for the binding of the finished cable harnesses can be placed at the beginning of this transport device.

An additional, not illustrated, discharge gripper could be provided and be disposed in place of a discharge device or a transport device, as indicated above. The discharge gripper would take over the finished cable harnesses as well as the defectively mounted cable harnesses from the gripper 3 of the industrial robot 1. For example, the discharge gripper slides and hangs the perfect cable harnesses onto a first sliding track of a hanger support bearing and the defective cable harnesses onto a second sliding track of the hanger support bearing. Independent of its length, each cable harness then hangs with a connector shell in the sliding track, ready for further process steps. This solution has the advantage that the path is short for the robot gripper 3 of the industrial robot 1 for the transfer of the cable harness to the discharge gripper. Therefore, the robot gripper 3 of the industrial robot 1 is quicker ready for the gripping of new, unmounted connector shells.

FIGS. 9 through 15 shows in sequence the various phases of the attachment and mounting operation of a connector shell 5 to an end equipped with a contact part 8.1, 8.2 of an electric conductor. The individual parts in these figures are designated with the same reference numerals as in FIGS. 1 through 8. The electric conductor 8 is held by the intermediate module 33 in the transfer position 30 (FIG. 9). The centering module 34, with the gripper pairs 34.2 and 34.3 displaced by 180 degrees, is brought to the contact part 8.1, 8.2, and the gripper pairs 34.2 and 34.3 grip the contact part 8.1. The outer and the inner gripper pair 11.1, 11.2 of the double gripper can grip the electric conductor 8 on both sides next to the intermediate module 33.

The electric conductor 8 and the contact part 8.1 are gripped by the outer and by the inner gripper pair 11.1, 11.2 in the mounting position, as illustrated in FIG. 1, and are moved in between the open grippers of the stationary gripper 20. The connector shell 5, gripped by the gripper tool of the robot gripper 3, is equipped with an already mounted contact part 8.1 and is carried to the gripped contact part 8.1.

Figure 11:
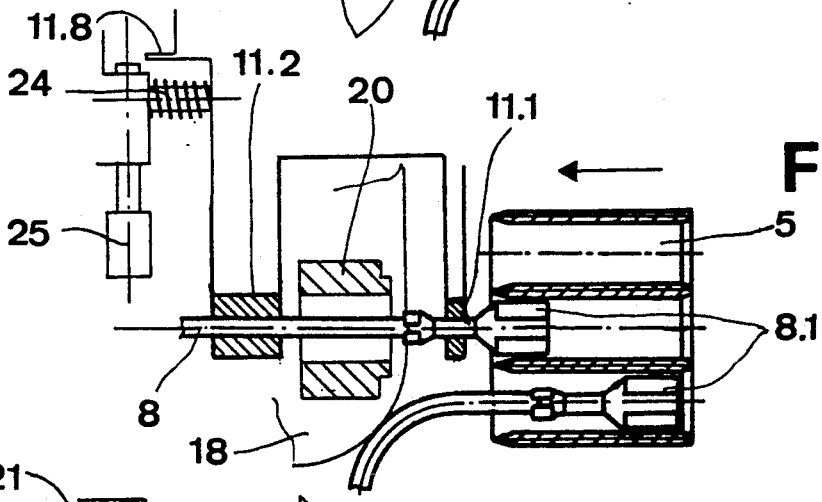
FIG. 11 shows a sectional, elevational view of a third phase of the mounting of the connector shells to the contact parts of electric conductors, illustrating a connector shell mounted with the robot gripper, accompanied by simultaneous monitoring of the mounting force at the end of the electrical conductor, gripped by the double gripper, and subsequent taking over of the electric conductor with the stationary gripper.

FIG. 11 illustrates the connector shell mounted to the contact part 8.1. The movably supported double gripper 11 with the outer and the inner gripper pair 11.1, 11.2 is maintained in an operative position with the force of the pretension spring 24. The sensor 25 surveys a possible movement of the double gripper 11 with the aid of a sheetmetal tongue 11.8.

Figure 12:
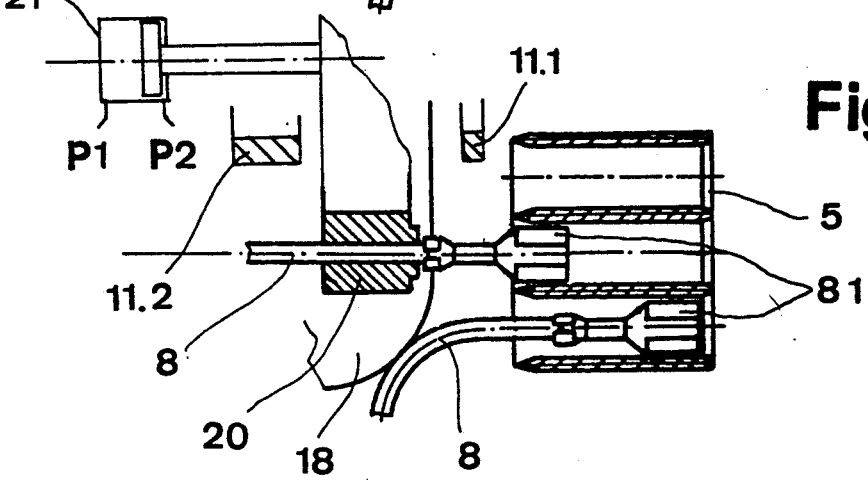
FIG. 12 shows a sectional, elevational view of a fourth phase of the mounting of the connector shells to the contact parts of electric conductors, illustrating the double gripper, both gripper pairs open, the end of the electric conductors being gripped with the stationary gripper, as well as a monitoring of the mounting pressure Pl by the stationary gripper.

The end of the electric conductor is gripped by the stationary gripper 20 according to FIG. 12, whereas the outer gripper pair 11.1 is open and is moved away from the electric conductor 8 and the inner gripper pair 11.2 is pivoted away. The pneumatic control device 21 with the mounting force Pl or, respectively, the withdrawal force P2 is mainly illustrated and is coordinated to the stationary gripper 20.

Figure 13:
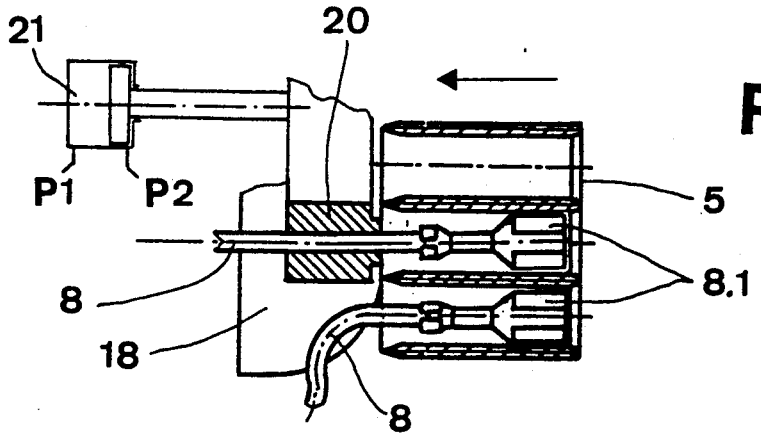
FIG. 13 shows a sectional, elevational view of a fifth phase of the mounting of the connector shells to the contact parts of electric conductors, illustrating the mounting of a connector shell to the end of an electric conductor with a robot gripper.

FIG. 13 shows an embodiment where the connector shell 5 is completely mounted onto the contact part 8.1.

Figure 14:
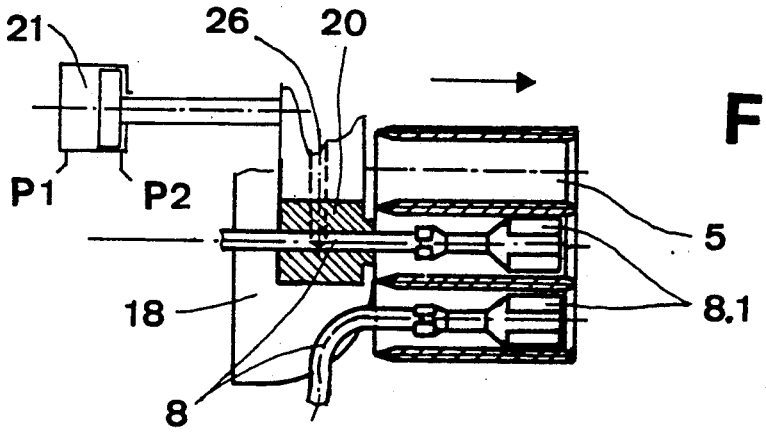
FIG. 14 shows a sectional, elevational view of an alternate fifth phase of the mounting of the connector shells to the contact parts of electric conductors, illustrating the monitoring of the separating pressure P2 by withdrawing the connector shells from the stationary gripper.

In FIG. 14, the stripping and withdrawal of the connector shell 5 from the contact part 8.1 is indicated where the withdrawal force is checked with the aid of the withdrawal force P2 of the pneumatic control device 21. The stationary gripper 20 exhibits a discharge device 26 provided for the discharging of defective electric conductors 8 from the work area.

Figure 15:
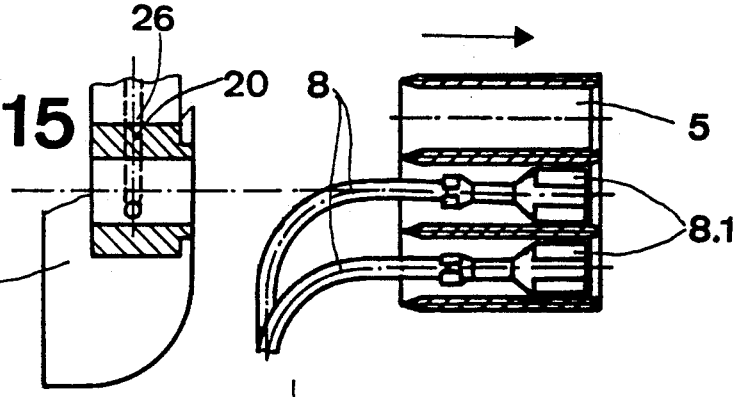
FIG. 15 shows a sectional, elevational view of a sixth phase of the mounting of the connector shells to the contact parts of electric conductors, illustrating a possible alternative embodiment for the outer gripper pair of the double gripper.

FIG. 15 indicates how the correctly mounted electric conductor 8 is placed by a separating motion of the connector shell 5 under the fixed separator element 18 in case of an open, stationary gripper 20, which is further illustrated in FIGS. 12, 13, and 14.

The above described device operates as follows:

Electric conductors 8 for the production of cable harnesses 13 are cut to length and the conductor ends are prepared and provided with contact parts 8.1, 8.2 on the processing line 9 of an independent cable-processing station. The electric conductors 8 are transferred by a first transfer module 10 at the end of the processing line 9 in the transfer position 30 to a stationary intermediate module 33. In a position at the stationary intermediate module 33, the contact parts 8.1, 8.2 of the electric conductor 8 are brought into the desired position by a centering module 84 of a centering device 19 with the gripper pairs 34.2 and 34.3, displaced by 180 degrees, and subsequently the electric conductors 8 are taken up with the double grippers 11 (phase 1). The prepared contact part 8.1, 8.2 is gripped, in each case, by the outer gripper pair 11.1 of the double gripper 11 in the rear region of the contact part 8.1, 8.2, whereas the inner gripper pair 11.2 grips in the region of the insulation of the electric conductor 8. The electric conductor 8, thus gripped by the double gripper 11, is moved into the transfer position in an operating cycle with the additional transfer module 40. In the transfer position, the two stationary grippers 20 protrude between the outer and the inner double gripper 11.1, 11.2.

The device for the automatic mounting of the electric conductors 8 and the connector shells 5, disposed outside of the cable-processing station, is in the meantime prepared for the mounting of the connector shells 5. The gripper arm 2 of each of the two industrial robots pivots with the robot gripper 3 and the gripper tool toward the front side of the parallel disposed connector-shell magazines 7.1, 7.2, 7.3. For example, the gripper tool 4 grips with the grippers 4.2 of the gripper module 4.1 three of the connector shells 5, prepositioned in one line by the connector-shell magazine 7. The connector shells 5, removed from the connector-shell magazines 7.1, 7.2, 7.3, are immediately replaced by the next connector shells 5 supplied automatically. The gripper arm 2 of the industrial robot 1 moves with the gripped connector shells 5 in the conductor plane 31 into the region of the mounting position in front of the first contact part 8.1, 8.2 of the electric conductor 8 held by the double gripper. In this case, the axis of the specific insertion opening of the connector shell 5 is flush with the axis and the shape of the gripped contact part 8.1, 8.2 of the electric conductor 8, wherein the gripped contact part 8.1, 8.2 is aligned with the aid of the inserted centering device 19 (phase 2).

The robot gripper 3 is now displaced with the gripper tool 4 and the gripped connector shells 5 in axial direction toward the contact part 8.1, 8.2 of the electric conductor 8 until the contact part 8.1, 8.2 of the electric conductor 8 grips into the insertion opening (phase 3).

During the mounting of the connector shells, damages at the connector shells by defective or not correctly aligned contact parts 8.1, 8.2 of the electric conductor 8 are prevented by two gripper pairs 11.1, 11.2 of the double grippers 11, which are slidably supported parallel to the axis of the gripped electric conductor 8 and which are held in the normal operative position by the pretensioned spring 24. If for example the contact part 8.1, 8.2 contacts and engages for any reason at the connector shell 5, then the two gripper pairs 11.1, 11.2 are slightly displaced by the connector shell 5 against the force of the spring 24. Then, a sheet-metal tongue 11.8 of the gripper pairs 11.1, 11.2 covers the front side of the non-contact sensor 25. The sensor 25 responds and the mounting motion of the connector shell 5 with the robot gripper 3 is interrupted. Following a short reverse motion of the connector shell 5, a second mounting attempt is induced, where the robot gripper 3 with the gripped connector shell 5 can possibly perform additional relative motion to allow for an easier mounting. Should this manipulation also not be successful, the electric conductor 8 is removed and a newly furnished electric conductor is expected and subjected to a controlled motion. The pretensioning force of the spring 24 is selected such that the spring is not influenced by the friction force during the mounting of a connector shell 5 to the perfect contact part 8.1, 8.2 of an electric conductor 8 and the operative position of the two gripper pairs 11.1, 11.2 is maintained.

The stationary grippers 20 close and take over the electric conductor 8 from the double gripper 11 subsequent to a perfect and flawless mounting. The outer and the inner gripper pair 11.1, 11.2 of the double gripper 11 open and the outer gripper pair 11.1 is displaced with the aid of the pneumatic device 11.3 and the sliding guide 11.6 out of the conductor plane 31 such that the end of the electric conductor 8 is now only held by the stationary gripper 20. While the double gripper 11 carries out a reverse operating cycle motion with the additional transfer module 40 into the transfer position for the taking up of a new electric conductor 8 from the cable-processing line, the connector shell 5 is mounted onto the contact part 8.1, 8.2 and, simultaneously, the mounting force is surveyed with the, for example, pneumatic control device 21 of the stationary gripper 20. If the mounting pressure Pl of a fixedly set selectable value is exceeded, then the contact part 8.1, 8.2 of the electric conductor 8 is defective and the electric conductor 8 is discarded (phase 4).

If the set value of the mounting pressure P1 is not reached, then the connector shell 5 is completely slid onto the contact part 8.1, 8.2 of the electric conductor 8 with the aid of the robot gripper. Subsequently, the withdrawal force is also surveyed with the pneumatic control device 21 of the stationary gripper 20 (phase 5). If the withdrawal pressure P2 does not reach a selectable, fixedly set value, then the mounting support of the connector connection is insufficient and the electric conductor 8 is discarded. This can for example be carried out by separating the connector shell 5 from the contact part 8.1, 8.2 of the electric conductor 8 and by discharging the electric conductor 8 from the operation area with opened stationary gripper 20 via the discharge device 26. If the withdrawal pressure P2 reaches the predetermined set value, then the stationary gripper 20 opens and frees the electric conductor 8. The connector shell 5 together with the electric conductor 8 is pulled away and separated from the stationary gripper by the robot gripper 3 in a direction opposite to the mounting direction. The last conductor 8, connected to the connector shell together with other electric conductors 8, is placed under the fixed separator element 18 by a corresponding withdrawal motion by the robot gripper 3. This provides for the necessary free space for the mounting of the connector shell 5 onto further contact parts 8.1, 8.2 of electric conductors 8. Further electric conductors 8 are cyclically taken over by the double gripper 11 of the additional transfer module 40, are transferred to the stationary gripper 20, and are combined with connector shells in the same way as described above until all desired insertion openings of the connector shells 5 are provided with electric conductors 8 and a completely mounted cable harness is formed. It is in addition necessary for this to slide the robot gripper 3 of the industrial robot 1 with the connector shell 5 from one insertion opening of a connector shell to an arbitrary other insertion opening, wherein the axis of the respective insertion opening is aligned with the axis of the gripped contact part 8.1, 8.2 of the electric conductor 8. Alternatively, the shape and the position of the contact part 8.1, 8.2 can be adapted to the shape and the position of the insertion opening of the connector shell 5 by way of an insertable centering device 19. Upon elimination of a defective electric conductor 8, the mounting of the connector shells 5 continues with the next electric conductor 8 and a next opening of the connector shell 5 until all programmed mounting steps have been carried out. Each not perfectly equipped cable harness, where one or several electric conductors 8 are missing, is automatically separated at the end and is supplemented by a post control and a post mounting.

The second contact part 8.2 of the electric conductor 8 is normally connected and attached at the same time to a connector shell 5 with the aid of a second industrial robot 1, as described. However, it could easily be possible, but with cycle time losses, to rotate the electric conductor 8 in an intermediate position between the transfer position 30 and the mounting position 32 in a horizontal plane by 180 degrees with the aid of the double gripper 11 or the rotation module 45, respectively, subsequent to the mounting of the first contact part 8.1., in order to furnish and attach the second contact part 8.2 to a connector shell 5 with the aid of the same industrial robot 1 in the above described manner.

Figure 16:
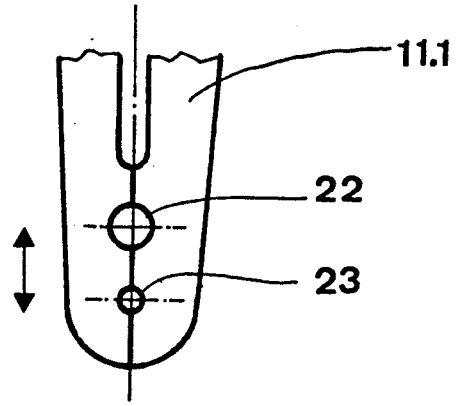
FIG. 16 is a schematic view of a gripper element.

It is also feasible to furnish the grippers of the outer gripper pair 11.1 of the double gripper according to FIG. 16 with more than one insertion opening for the reception of a contact part 8.1, 8.2, in order to receive, for example, different contact parts with corresponding openings 22, 23. In this case, the gripper can be displaced perpendicular to the axial direction of the gripped electric conductors 8 into at least two positions.

It will be understood that each of the elements described above, or two or more together, may also find a useful application in other types of devices for an automatic mounting of electric conductors differing from the types described above.

While the invention has been illustrated and described as embodied in the context of a device for an automatic mounting of electrical connectors to contact parts in connection shells, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A method of making an electrical harness with terminal connectors for connector shells comprising the following process steps:

gripping at least one connector shell from a connector-shell magazine with a gripper tool supported by a robot gripper; centering two contact paris of an electric conductor at an end of a cable-processing line;

maintaining the two contact parts in a rest position at an insulated conductor by respectively an outer gripper pair and an inner gripper pair of a first double gripper;

moving the robot gripper in the direction of a contact part of the electric conductor;

shifting a connector shell having a recess, with the recess to align at a contact part of the electric conductor; opening of the outer gripper pair of the first double gripper by itself, where the outer gripper pair grips said contact part of the electric conductor;

shifting the connector shell with a gripper fully onto the contact part of the electric conductor; inserting the contact part into a recess of the connector shell;

opening the inner gripper pair of the first double gripper; carrying out a separating motion below a fixed separator element by the gripper with the inserted electric conductor for obtaining a finished equipped cable harness.

2. The method according to claim 1, further comprising repeating the inserting step of the connector shell at the contact part of the electric conductor upon a surpassing of a preset insertion force after a return motion of the robot gripper;

rejecting an electric conductor after repeating a predetermined number of the inserting steps;

moving the robot gripper in a reverse direction relative to the insertion direction;

testing the mechanical stability of the alignment of the connector shell relative to the gripper tool;

rotating the first double gripper by half a rotation around its longitudinal axis for inserting the second contact part of the electric conductor with a second connector shell;

binding said electric conductor having connector shells to form a finished cable harness;

testing the cable harness electrically.

3. A method for the automatic mounting of electric conductors (8) with contact parts (8.1, 8.2) in connector shells (5) with a gripper system, including the following process steps:

a gripper tool (4), supported by a robot gripper (3) grips at least one connector shell (5) furnished by a connector-shell magazine (7.1, 7.2, 7.3), the two contact parts (8.1, 8.2) of the electric conductors (8) are centered at the end of a cable-processing line (9) and are maintained in a rest position at a contact part (8.1, 8.2) and at the electric conductor (8) by respectively an outer gripper pair (11.1) and an inner gripper pair (11.2) of a first double gripper (11), wherein the robot gripper (3) moves in the direction of a contact part (8.1, 8.2) of the electric conductor (8) and shifts a connector shell (5) with one of its recesses to align at a contact part (8.1, 8.2) of the electric conductor (8), the outer gripper pair (11.1) of the first double gripper (11), gripping at the contact part (8.1, 8.2) of the electric conductor (8), opens itself, the robot gripper (3) shifts the connector shell (5) fully onto the contact part (8.1, 8.2) of the electric conductor (8), the inner gripper part (11.2) of the first double gripper (11) opens, the robot gripper (3) carries out with the inserted electric conductor or conductors a separating motion below a fixed separator element (18).

4. The method according to claim 3, wherein the slide-on process of a connector shell (5) at the contact part (8.1, 8.2) of the electric conductor (8) is repeated upon a surpassing of a preset put-on force after a return motion of the robot gripper (3);

wherein the electric conductor (8) is eliminated after a failing in a repeating of the slide-on process;

wherein the robot gripper (3) tries to perform a motion opposite to the shift-in direction for testing the assembly process of the connector shell (5) on the contact part (8.1, 8.2) of the electric conductor (8);

wherein the first double gripper (11) is rotated by half a rotation around its longitudinal axis for plugging together the second contact part (8.2) of the electric conductor (8) with connector shells (5);

wherein the finished equipped cable harness (13) is bound off;

wherein the cable harness (13) is electrically tested.

* * * * *

UNITED STATES PATENT AND TRADEMARK OFFICE

CERTIFICATE OF CORRECTION

PATENT NO. : 5,157,830

DATED : October 27, 1992

INVENTOR(S) : Max Koch, Alois Lustenberger

It is certified that error appears in the above-identified patent and that said Letters Patent is hereby corrected as shown below:

Title page under [75] Inventor: delete "STAATSANGEHORIGKEIT" and substitute therefor --MEGGEN--.

Title page under [75] Inventor: insert after "SWITZERLAND" --ALOIS LUSTENBERGER, LUCERNE, SWITZERLAND--.

Title page, item [19], add --et al--

Signed and Sealed this

First Day of March, 1994

Bruce Lehman

*Attest:*

BRUCE LEHMAN

*Attesting Officer*

*Commissioner of Patents and Trademarks*